United States Patent [19]

Kearney et al.

[11] 4,225,382

[45] Sep. 30, 1980

[54] METHOD OF MAKING PLY-SEPARABLE PAPER

[75] Inventors: Donald R. Kearney, Cincinnati; Paul D. Trokhan, Hamilton; Edward R. Wells, Cincinnati, all of Ohio

[73] Assignee: The Procter & Gamble Company, Cincinnati, Ohio

[21] Appl. No.: 41,846

[22] Filed: May 24, 1979

Related U.S. Application Data

[63] Continuation of Ser. No. 870,785, Jan. 19, 1978, abandoned.

[51] Int. Cl.[3] ..... D21H 5/24; B21F 1/12

[52] U.S. Cl. ..... 162/111; 162/132; 162/130

[58] Field of Search ..... 162/111, 124, 129, 130, 162/133, 132, 207, 113; 428/153, 154

[56] References Cited

U.S. PATENT DOCUMENTS

| | | | |
|---|---|---|---|
| 1,606,428 | 11/1926 | Kirschbraun | 162/127 |
| 3,994,771 | 11/1976 | Morgan et al. | 162/113 |

FOREIGN PATENT DOCUMENTS 2528311 1/1976 Fed. Rep. of Germany .

*Primary Examiner*—William F. Smith

*Attorney, Agent, or Firm*—Fredrick H. Braun; Richard C. Witte; Thomas H. O'Flaherty

[57] ABSTRACT

An improved process to produce a novel tissue which becomes ply-separable during the papermaking process. In a first embodiment of the invention a two-layered stratified web is formed, having a first layer comprised of a relatively low consistency slurry of long papermaking fibers and a second layer comprised of a high consistency slurry of relatively short papermaking fibers. In a second embodiment of the invention, a stratified web having three layers is formed, comprised of well-bonded layers separated by an interior barrier layer. These improved tissue products need not be creped from a creping roll with a doctor blade in order to exhibit ply-separability, and they may be creped in a single step to form a finished product which is creped all the way through.

11 Claims, 10 Drawing Figures

Fig. 6
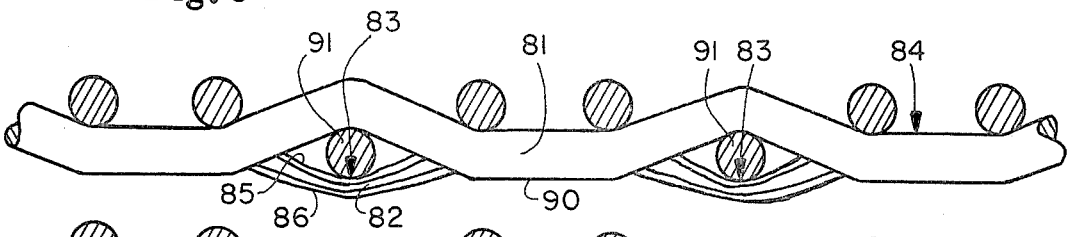
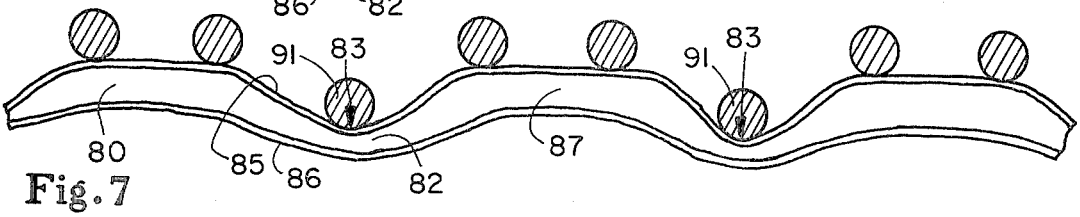
Fig. 7
Fig. 8
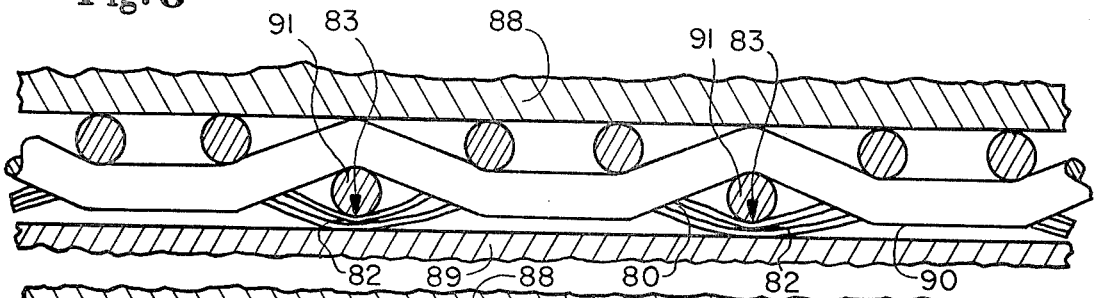
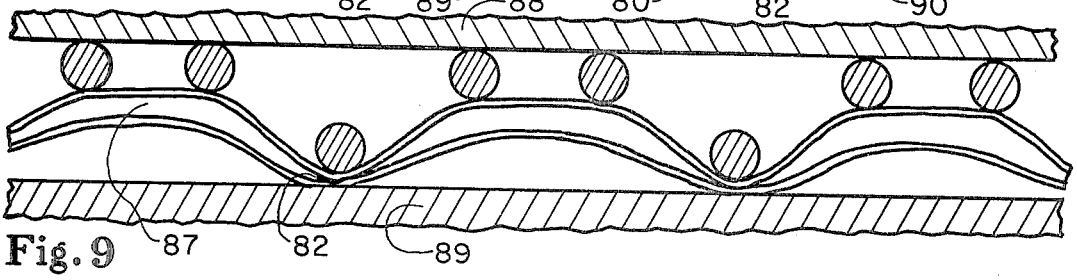
Fig. 9
Fig. 10
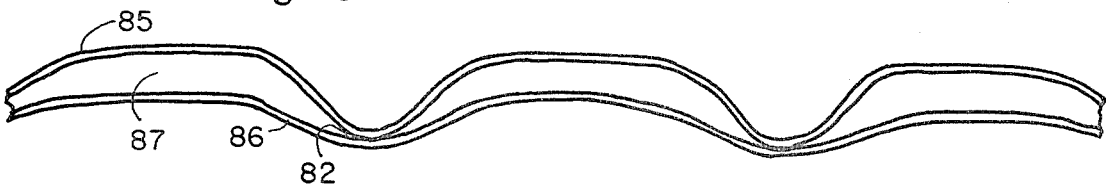

METHOD OF MAKING PLY-SEPARABLE PAPER

This is a continuation, of application Ser. No. 870,785, filed Jan. 19, 1978, now abandoned.

FIELD OF THE INVENTION

The present invention relates to improvements in wet-laid web manufacturing operations, especially those utilized for producing soft, bulky, absorbent paper sheets suitable for use in tissue, toweling, and sanitary products. In particular, the present invention relates to the provision of a ply-separable stratified web formed from more than one fiber slurry, said stratified web being subsequently conformed to the surface of an open mesh drying fabric by the application of a partial vacuum to the web and then thermally predried on the foraminous intermediate drying fabric (hereinafter "intermediate drying fabric") as part of a low density papermaking process.

Unexpectedly, the process disclosed herein allows the use of a variety of creping techniques to form a ply-separable stratified web, and permits the web to be creped throughout in a single creping operation. The impressions of the intermediate drying fabric on the web influence the creping pattern. The resulting finished product is a single stratified web which is capable of separation into individual plies, and which in its unseparated state is characterized by creping which is substantially equal in frequency and simultaneous in phase in the several layers of the web.

BACKGROUND OF THE INVENTION

Ply-separability is desirable in a tissue product because a ply-separable web is believed by applicants to be more flexible than a conventional web of the same basis weight which is not ply-separable. The source of this hypothesis is the relation between thickness and flexural rigidity in a given material. The flexural rigidity of a member is proportional to the cube of its thickness in the direction in which a flexing force is applied. Thus, where a one-ply member has a thickness h, and thus a flexural rigidity proportional to $h^3$, a two-ply member with a combined thickness of h (each ply is h/2 thick) has a flexural rigidity proportional to $2(h/2)^3$, or $h^3/4$. Thus, in the case where the two plies of a two-ply member do not substantially interact at their interface, the flexural rigidity of the two-ply member is $\frac{1}{4}$ that of a one-ply member of equal thickness. This illustrates that to reduce the bonding between well-bonded layers of a web, forming distinct plies which resemble plural noninteracting members, is to increase the flexibility of a paper web of a given thickness.

Laminate paper and paper-like structures exhibiting ply-separability are well known in the art. For example, U.S. Pat. Nos. 514,059, issued to Bird on Feb. 6, 1894; 1,606,428, issued to Kirschbraun of Nov. 9, 1926; 1,964,793, issued to Richter on July 3, 1934; and 2,234,457, issued to Strovink on Oct. 9, 1937 demonstrate that a nonadhesive material applied between two outer layers of paper or the like can be used to produce a ply-separable structure. However, none of this early work is believed by applicants to disclose the creation of a ply-separable web which is useful in the manufacture of absorbent paper products.

A United States Patent Application, Ser. No. 481,532 (series of 1970), filed on June 21, 1974 by Charles F. Dunning et al., entitled "Creped Laminar Tissue and Process of Manufacture" and serving as the priority document for German Offenlegungsschrift 25 28 311, laid open on Jan. 8, 1976, describes various methods for producing a three-layered ply-separable tissue web. The essence of the disclosure is that a web may be formed having outer layers of strongly bonded fibers separated by an intermediate zone wherein intralayer bonding is reduced. When the web is subjected to creping from a creping roll using a doctor blade, this reference teaches that only the layer of the tissue adjacent the creping roll is creped, and a second operation is believed to be necessary to crepe the other side of the web in order to create a finished product. This application also discloses that ply-separability is imparted to the web as a result of the creping operation which shear the two outer layers from each other. The result of this process is said to be a tissue product having two ply-separable layers, formed such that the crepe in one well-bonded layer is independent in both frequency and phase of the crepe in the other well-bonded layer. The applicants believe that this process would be much more expensive to produce soft webs than the process disclosed hereinafter, since an additional creping step is required to crepe both exterior surfaces of the web. Furthermore, the Dunning, et al. application specifically requires creping with a doctor blade as an essential element to produce a ply-separable product, while the applicants have found that unique aspects of the process disclosed hereinafter permit the use of many creping techniques.

The applicants are not aware of any prior art respecting the use of differential consistency in a paper web formed in two layers to create a ply-separable product.

U.S. Pat. No. 3,994,771, issued to Morgan et al. on Nov. 30, 1976 and commonly owned with this application, discloses the general type of papermaking machinery which may be used to produce paper according to the present invention. This reference, as well as others, can be distinguished from the present invention in that there is no teaching that this process can be used to make ply-separable products. Such a result is unexpected when using this process because, according to the teachings of Morgan et al, small isolated areas of the web strata are compressed together to form discrete densified areas corresponding to the knuckle pattern in the foraminous intermediate drying fabric, which would be expected to cause the two layers to adhere together rather than to separate. This reference does disclose, however, that the knuckle impression imparted by the drying fabric creates sites at which the web is predisposed to buckle, so that the mesh of the drying fabric influences the fineness of creping. This prior art reference discloses that a stratified web may be creped all the way through, although this teaching would not be expected to apply to the creping of a web to which ply-separability is imparted prior to creping.

SUMMARY OF THE INVENTION

Tissue of the present invention is formed by wet-laying a stratified web.

In a first embodiment of the invention a web is formed in one or more forming sections of a papermaking machine, and comprises at least a first layer of short papermaking fibers and a second layer of long papermaking fibers. The first and second layers may be deposited from a single divided headbox of a single forming section, in which case the consistency of the first layer as it leaves the headbox is about 0.25 to 0.6 percent fiber by weight, and the consistency of the second layer as it leaves the headbox throat is about 0.1 to 0.3 percent fiber by weight. Alternatively, the first and second layers may be deposited from separate headboxes of separate forming sections, dewatered so that one layer, preferably the short-fiber fabric side ayer, has a much lower consistency than that of the second layer. The layers are then combined into a single stratified web while still in the wet end of the papermaking machine.

In a second embodiment of the invention a three-layered stratified web is formed in one or more forming sections, comprised of two well-bonded layers separated by a barrier layer which isolates the bonding within one well-bonded layer from the bonding within the other well-bonded layer.

In either embodiment of the invention, the web is rendered ply-separable by transferring it to a foraminous intermediate drying fabric having a mesh of such a fineness that the machine direction distance between adjacent rows of knuckles in the drying fabric is approximately 0.2 to 1.0, or more preferably about 0.3 times the length of the long papermaking fibers in the well-bonded layers of the stratified web. Transfer is effected by applying a partial vacuum to the opposing sides of the web. This partial vacuum is important because it tends to isolate the ply-separable areas of the web from each other, and thus it enables the web to become ply-separable when it is dried. If the web is dried completely at this point, it will be ply-separable. However, after the web is dried it is desirably creped, using any one of a number of known methods in a single creping operation to produce a finished tissue web. The creping of the several layers of the web is equal in frequency and simultaneous in phase, the crepe frequency depending upon the distance measured in the machine direction between successive cross-machine direction rows of knuckle impressions in the web, and depending also on the draw of the take-up reel. The finished tissue web is ply-separable, which means that, although the web normally exists as a single sheet, the two separable layers of the web can be peeled apart into two plies without substantially destroying the bonds within the respective separable layers.

A web having ply-separable layers which are creped as a unit, so that the creping pattern in all layers of the web is equal in frequency and simultaneous in phase and the plies nest together, exhibits properties which are advantageous compared with the webs disclosed in the prior art. Specifically, the tissue of this invention has very good wicking properties and absorbency, as well as an outstanding subjective impression of softness compared with prior art tissue products.

BRIEF DESCRIPTION OF THE DRAWINGS

FIG. 6 is a schematic side elevational enlarged view of a web of the present invention as it resides on the intermediate drying fabric.

FIG. 7 is a view identical to FIG. 6, except that a machine direction filament is removed so that the entire web is visible.

FIG. 8 is a schematic side elevational view of buckling sites created in the web by passing it through a nip between a pressure roll and the Yankee dryer.

FIG. 9 is a view identical to FIG. 8, except that a machine direction filament is removed so that the entire web is visible. FIG. 10 is a schematic side elevational view of a longitudinal section of a finished product with nesting separable plies, made according to the invention.

Figure 1:
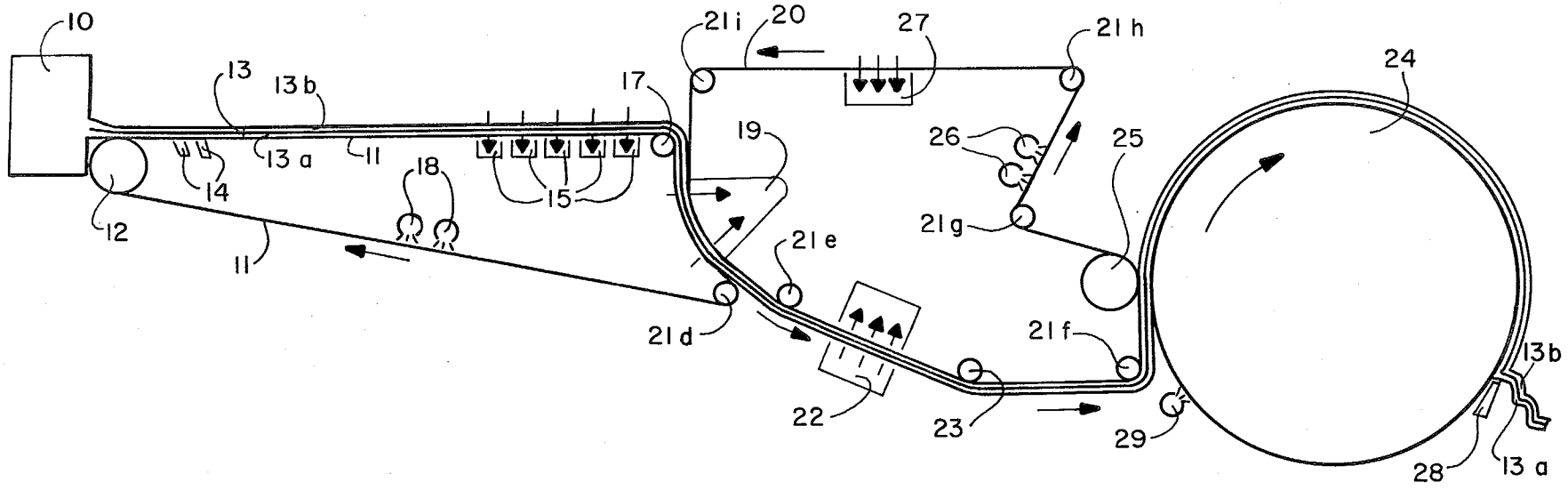
FIG. 1 is a schematic side elevational view of a papermaking machine used to practice the invention, having a single forming section and a divided headbox.

While several embodiments of the present invention are described with great particularity hereinafter to enable persons skilled in the art to make and use the invention, the applicants do not intend thereby to limit the scope of their invention, which is defined by the claims concluding this specification.

DEFINITIONS

A stratified web as used herein is a single paper web made up of plural layers with distinct properties. While a small degree of mixing between strata at their interfaces is inevitable, such mixing is desirably held to a minimum in accordance with the present invention.

A papermaking bond as used herein is an electrostatic bond, including but not limited to hydrogen, ion-dipole, and dipole-dipole bonds. This includes bonds occurring directly between fibers, as well as bonds occurring indirectly between fibers through an electrostatically bondable non-cellulosic material.

A barrier layer as used herein is a layer of material interposed between layers which are to be ply-separable in order to prevent those layers from substantially interacting with, or becoming substantially bound to each other while the barrier is maintained.

The fabric side of the web as used herein is the layer or major face thereof which is in conforming contact with the intermediate drying fabric at that stage of the papermaking process.

The wire side of the web as used herein is the layer or major face thereof opposite the fabric side of the web.

Long papermaking fibers as used herein are fibers of the types customarily used for papermaking, typically cellulosic fibers having a length in the range of about 0.08 to about 0.12 inches or more.

Short papermaking fibers as used herein are fibers, of the types customarily used for papermaking, typically cellulosic fibers having a length in the range of about 0.01 to about 0.08 inches.

A knuckle as used herein is a point in the intermediate drying fabric where woof and warp filaments overlap.

Creping as used herein is broadly defined to mean any paper web processing technique which longitudinally compresses the web in order to improve its bulk, softness, and other qualities. Examples of creping are the MICREX and CLUPAK proprietary processes described hereinafter, as well as Yankee creping.

The impact angle as used herein is the plane angle defined by the beveled face of a doctor blade and by the downstream segment of a plane tangent to the surface of a Yankee dryer at the point of intersection of the dryer and blade. The impact angle defines the angle on which a paper sheet is deflected when in contacts the doctor blade during Yankee creping.

MICREX creping as used herein is a propietary method for creping a web by conveying it between a driving roll and a stationary surface into a retarding zone so that the speed of the web as it enters the retarding zone exceeds the speed of the web as it leaves the retarding zone. Patents describing this process in greater detail are incorporated by reference hereinafter.

CLUPAK creping as used herein is a proprietary method for creping a web by applying a compressive force parallel to the respective faces of a paper web in a longitudinal direction while simultaneously applying a force perpendicular to said faces. A patent describing this process in greater detail is incorporated by reference hereinafter.

Ply-separability as used herein is a property of webs made according to the present invention. Such webs ordinarily exist as a single stratified web, and are not intended to delaminate while in normal use, but are separable into two plies (or more) without destroying the layers immediately adjacent the plane of separation.

Two-layer embodiments of the invention as used herein are those embodiments of the invention having no distinct layer interposed between the two play-separable layers. It should be noted, however, that a two-layer embodiment may have additional layers on either or both sides of the ply-separable portions of the web.

Three-layer embodiments of the invention have a sandwich construction comprising two ply-separable layers, separated during at least part of the papermaking process by a barrier layer of material which isolates the ply-separable layers to prevent them from bonding to each other. Of course, the central layer must either be non-cohesive, or non-adhesive to the ply-separable layers, to allow the layers to separate. Again, the three-layer embodiment may have additional layers on either or both sides of the ply-separable portions of the web.

DESCRIPTION OF THE PREFERRED EMBODIMENTS

Referring to FIG. 1, there is shown an example of a papermaking machine capable of producing paper according to the present invention. The papermaking furnish is delivered from a closed headbox 10 to a Fourdrinier wire 11, supported by a breast roll 12. An uncompacted paper web 13 comprising at least a wire side layer 13*a* and a fabric side layer 13*b* is formed, and the Fourdrinier wire passes over forming boards 14, which are desirable but not necessary. Toward the dry end of the forming section the Fourdrinier wire 11 with the wet paper web 13 supported thereon passes over a plurality of vacuum boxes 15. Five such vacuum boxes are shown in the illustration. After passing over the vacuum boxes 15, the Fourdrinier wire and the moist web pass around a Fourdrinier wire roll 17, and downwardly adjacent a pick-up shoe 19. Pick-up shoe 19 draws a sufficient vacum with respect to the ambient pressure to create a pressure differential across web 13 which reduces the adherence between wire side layer 13*a* and fabric side layer 13*b*, thus rendering layers 13*a* and 13*b* of the web ply-separable. Also as a result of the pressure differential created by pick-up shoe 19, the paper web 13 is transferred without compaction to the intermediate drying fabric 20. At the same time, Fourdrinier wire 11, which is now free of web 13, passes around wire return roll 21*d* and is cleaned by water sprays 18 before returning around breast roll 12 to complete its cycle.

The web on the drying fabric is first carried over roller 21*e* to the vicinity of a hot air dryer 22. The intermediate drying fabric and the thermally pre-dried paper web then passes over a straightening roll 23, which prevents the formation of wrinkles in the intermediate drying fabric, and over another intermediate drying fabric roll 21*f* for transfer onto the surface of a Yankee dryer drum 24. The pressure roll 25 causes the knuckles of the intermediate drying fabric 20 to be impressed into the pre-dried paper sheet 13 during transfer to the Yankee surface. The intermediate drying fabric 20 then returns to the vicinity of Fourdrinier wire 11 over several return rolls 21*g, h,* and *i,* being washed free of clinging fibers by sprays 26 and dried by vacuum box 27 during its return. The paper sheet 13 is carried around the periphery of the Yankee dryer drum 24 for drying and is desirably creped from the Yankee dryer surface by a doctor blade 28. Typically, the surface of the Yankee dryer is sprayed with a small amount of an adhesive from spray head 29 to improve the bond between the knuckle imprints of the paper sheet and the Yankee dryer surface during drying.

Figures 2, 3:
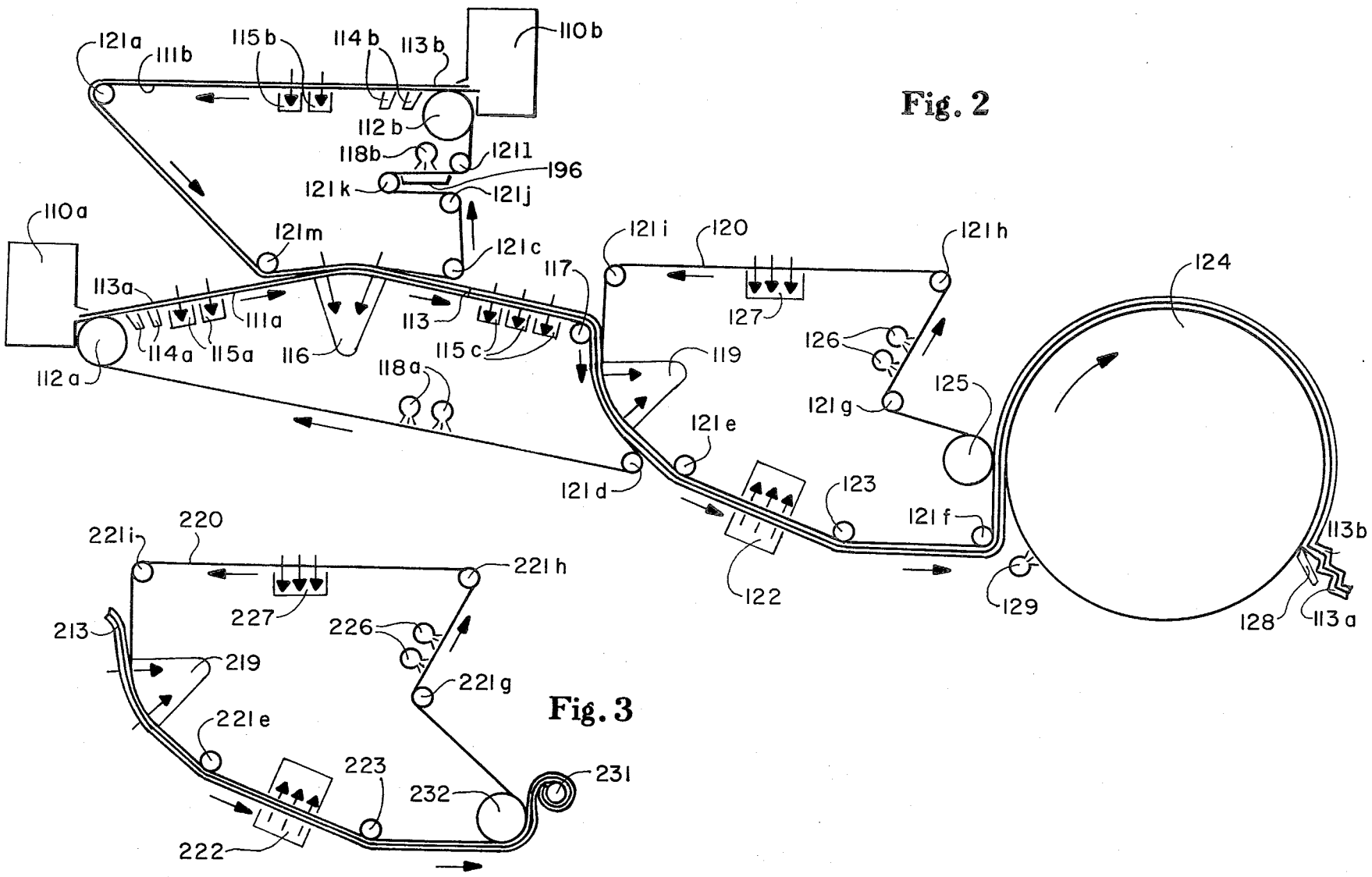
FIG. 2 is a schematic side elevational view of a second type of papermaking machine, having two forming sections. Two headboxes, which may each be single or divided, are used.
FIG. 3 is a schematic side elevational view of an intermediate drying section of a papermaking machine wherein the web is wound directly from the intermediate drying fabric so that creping may be performed, if desired, in a separate operation.

FIG. 2 illustrates another papermaking machine which may be used to practice the present invention. A first papermaking furnish is delivered from closed headbox 110*a* to a Fourdrinier wire 111*a* supported by breast roll 112*a*. An uncompacted web 113*a* is formed and Fourdrinier wire 111*a* passes over forming boards 114*a,* which are desirable but not necessary. The web 113*a* passes over vacuum boxes 115*a* to increase its consistency. Simultaneously, a second papermaking furnish is delivered from closed headbox 110*b* to a second Fourdrinier wire 111*b* supported by breast roll 112*b*. A second uncompacted paper web 113*b* is formed, and Fourdrinier wire 111*b* passes over the forming boards 114*b,* which again are desirable but not necessary; vacuum boxes 115*b* serve to increase the consistency of web 113*b*. Webs 113*a* and 113*b* are dried at this early stage to different consistencies, as further described hereinafter. Webs 113*a* and 113I b are combined into a single stratified web by the action of vacuum box 116 which creates a pressure differential between the wire side of web 113*a* and the wire side of web 113*b*, so that thereafter webs 113*a* and 113*b* form a single stratified web 113. Toward the dry end of the forming section the Fourdrinier wire 111*a,* with the wet paper web 113 supported thereon, passes over additional vacuum boxes 115*c* to further dry and unify stratified web 113. After passing over vacuum boxes 115*c,* Fourdrinier wire 111*a* and the moist web 113 pass around a Fourdrinier wire roll 117 and downwardly adjacent a pick-up shoe 119. At this point the paper web 113 is transferred without compaction to intermediate drying fabric 120 by a pressure differential between opposing sides of the web created by pick-up shoe 119, which again contributes substantially to the ply-separability of the resulting web by tending to draw webs 113*a* and 113*b* apart.

After webs 113*a* and *b* have been removed from Fourdrinier wires 111*a* and *b,* respectively, wire 111*a* passes around return roll 121*d* and is washed by showers 118*a* before returning to breast roll 112*a* to complete its cycle, while wire 111*b* passes over return rolls 121*c,* 121*j,* 121*k,* 121*l,* and is washed by water shower 118*b* before returning to breast roll 112*b* to complete its cycle.

Meanwhile, web 113 on intermediate drying fabric 120 passes over roll 121*e* to a hot air predrier 122. The intermediate drying fabric and the thermally predried paper web then pass over a straightening roll 123 which prevents the formation of wrinkles in the intermediate drying fabric, and over another intermediate drying fabric roll 121*f* for transfer onto the surface of a Yankee dryer drum 124. The pressure roll 125 causes the knuckles of the intermediate drying fabric 120 to be impressed into the predried paper web 113 during transfer to the Yankee surface. The intermediate drying fabric 120 then passes over several return rolls 121*g*, 121*h*, and 121*i*, being washed free of clinging fibers by a discharge from spray heads 126 and dried by vacuum box 127 during its return. The paper sheet 113 is carried around the periphery of the Yankee dryer drum 124 and may be creped from the Yankee dryer surface by a doctor blade 128, although the Yankee drying and creping with a doctor blade are not essential to the invention, as will become apparent. If a Yankee dryer is used, its surface is typically sprayed with a small amount of adhesive solution from spray head 129 to improve the bond between the knuckle imprints of the paper sheet and the Yankee dryer surface during the drying period.

In a preferred embodiment of the invention, as seen in FIG. 2, a ply-separable paper is formed by making a wire side web layer 113*a* of long papermaking fibers on a first forming wire 111*a* and dewatering the web to a consistency of from about 10 to 25 percent fiber by weight. A fabric side web layer 113*b* of short papermaking fibers is formed on a second forming wire 111*b* and dewatered to a consistency of from about 5 to 15 percent fiber by weight, where the consistency of the wire side web layer is from about 5 to 10 percent by weight greater than the consistency of the fabric side web layer. The fabric side web layer 113*b* and the wire side web layer 113*a* are superimposed by juxtapositioning the first and second forming wires that form a combined web. Sufficient differential pressures are applied to the combined web by a vacuum box 116 to unify it into a stratified web 113 having a first and second adjacent strata which are weakly bound together by papermaking bonds. The stratified web 113 is then transferred to an intermediate drying fabric 120 through the application of a partial vacuum by pick-up shoe 119 to the stratified web 113 adjacent the fabric side layer which simultaneously reduces the adherence of the wire side and the fabric side layers to each other. The stratified web 113 is predryed to a consistency of about 50 to 90 percent fiber by weight. The stratified web 113 is then imprinted on a Yankee dryer 124 by a pressure roll 125 acting through the intermediate drying fabric 120 to form a multiplicity of discrete densified areas defining a pattern of spaced lines having a substantial orientation predisposed to buckle during creping. The stratified web 113 is then dryed to a consistency of from about 85 to 100 percent fiber by weight. The stratified web is then creped along each of the creping lines to form creping which is equal in frequency and simultaneous in phase in all layers of the web.

In another preferred embodiment of the invention, a ply-separable paper web is formed on two forming wires as seen in FIG. 2. The first headbox 110*a* deposits a first furnish on a first Fourdrinier wire 111*a* forming a wire side web layer 113*a* made of fibers capable of forming substantial papermaking bonds. A fabric side web layer 113*b* is formed on a second Fourdrinier wire 111*b* from furnish deposited from headbox 110*b* made of fibers capable of performing substantial papermaking bonds. A barrier layer is superimposed upon one of either the wire side web 113*a* or the fabric side web 113*b*. The fabric side web layer 113*b* as dewatered to a consistency of about 5 to 15 percent fiber by weight by forming boards 114*b* and vacuum box 115*b*. The wire side web layer 113*a* is dewatered to a consistency of about 10 to 25 percent fiber by weight, whereby the consistency of the wire side web layer is at least as high as the consistency of the fabric side web layer, by forming boards 114*a* and vacuum boxes 115*a*. The first and second Fourdrinier wires are juxtaposed with the fabric and wire side layers disposed therebetween forming a combined web having a barrier layer disposed between the fabric side and wire side layers. A differential pressure is applied to the stratified web by vacuum boxes 115*c* to form it into a unified web. The stratified web is then transferred to the intermediate drying fabric 120 by differential pressure applied by vacuum pick-up shoe 119. The stratified web 113 is predryed on the intermediate drying fabric to a consistency of about 65 to about 90 percent fibers by weight. The web 113 is imprinted on a Yankee dryer roll 124 by pressure roll 125 acting through the intermediate drying fabric 120, which forms a multiplicity of discrete densified areas in the web defining a pattern of spaced lines having a substantial orientation predisposed to buckle during creping. The stratified web 113 is dried to a consistency of 85 to about 100 percent fibers by weight on the Yankee dryer roll 124. The web 113 is then creped along the plural creping lines to form a creping pattern which is substantially equal in frequency and simultaneous in phase in all layers of the web.

FIG. 3 shows a modification of the intermediate drying fabric section of the machines shown in FIGS. 1 and 2 in order to bypass the Yankee dryer, permitting creping to be delayed and allowing the use of alternate creping methods. The unitary web 213 is transferred to the intermediate drying fabric 220 by the pressure differential caused by pick-up shoe 219, as described above. Paper web 213, which has been transferred to intermediate drying fabric 220 without compaction, continues over roll 221*e* to a hot air dryer 222. Since the web will not be transferred to a Yankee dryer to complete the drying of the web, it is desirable that hot air dryer 222 should apply a greater volume of air, apply hotter air, or should dry the web for a longer period of time than is the case when a Yankee dryer is used. When drying on the intermediate drying fabric, the stratified web is preferably dried to a consistency of from about 85 to about 100 percent fibers by weight. The intermediate drying fabric and the thermally dried paper web then pass over a straightening roll 223, which prevents the formation of wrinkles in the intermediate drying fabric, over drum roll 232, and then away from the intermediate drying fabric 220, whereupon the web is wound into parent roll 231 to be processed further. Of course, it will be obvious that winding and interim storage of the web on parent roll 231 could be eliminated, provided that after the web leaves intermediate drying fabric 220 it is conveyed to creping means for other further processing. Intermediate drying fabric 220 then passes over fabric return rolls 221*g*, *h*, and *i*, and the web is cleaned by showers 226 and dried by vacuum box 227 before returning to the vicinity of pick-up shoe 219 to complete its cycle.

In any of the methods disclosed herein, the stratified web may alternatively be dried on the intermediate drying fabric as disclosed immediately above or on the Yankee dryer roll.

Figure 4:
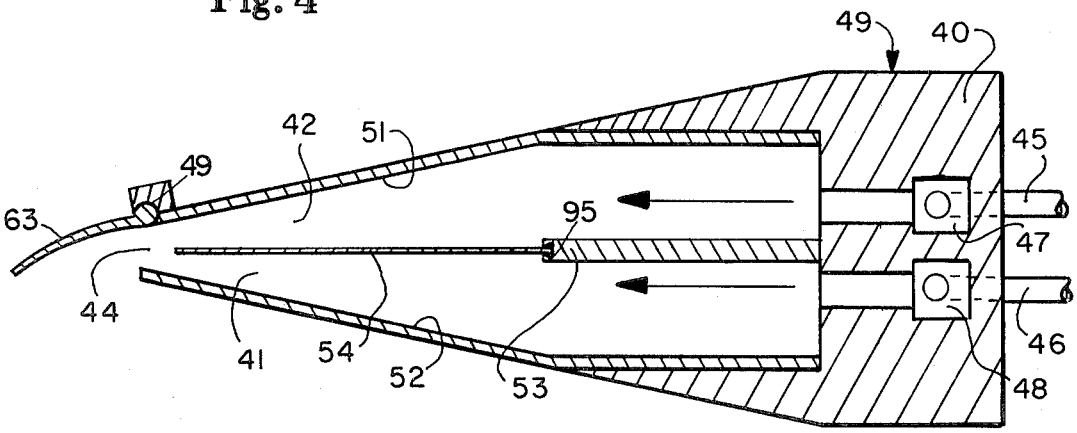
FIG. 4 is a schematic side elevational view of a two-channel fixed-roof headbox used in one embodiment of the invention.
Figure 5:
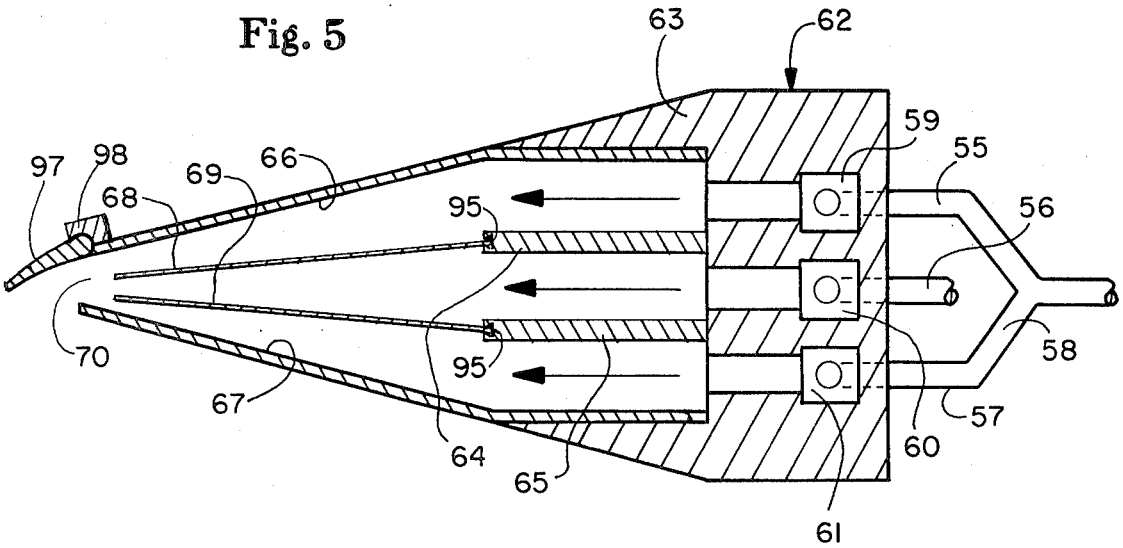
FIG. 5 is a schematic side elevational view of a three-channel fixed-roof headbox used in another embodiment of the invention.

FIGS. 4 and 5 schematically illustrate the type of construction of divided headboxes which may be used to practice some embodiments of this invention.

Referring to FIG. 4, a headbox 40 having first and second slurry depositing channels 41 and 42 may be used to simultaneously deposit a slurry comprising two superimposed layers in the practice of the two-layered embodiment of the invention. Supply pipes 45, 46 convey slurries from supply means (not shown) to supply chambers 47 and 48 of the headbox. The slurries flow past fixed separator 53 which divides the headbox into separate chambers. Flexible separator 54, attached to fixed separator 53 at pivoted knuckle joint 95, divides the two chambers from its point of attachment to fixed separator 53 to the outlet 44 of the headbox. The slurries are channeled by converging fixed plates 51, 52, while being maintained as separate slurries by flexible separator 54, and are deposited from outlet 44 onto a forming wire (not shown). In the single wire embodiment described herein, a fixed roof 63, attached by pivoted knuckle joint 49 to fixed plate 51, is employed.

In another preferred embodiment of the invention, a divided headbox having first and second slurry depositing channels deposits a first slurry of short papermaking fibers having a consistency of about 0.25 to 0.6 percent fibers by weight on a single forming wire 11 as seen in FIG. 1. A second slurry depositing channel deposits a second slurry of long papermaking fibers on the forming wire, superimposed on the first slurry, having a consistency of 0.1 to 0.3 percent fibers by weight and an average fiber length of about three times the average fiber length of the fibers in the first slurry and a flow rate of about two to three times the flow rate of the first slurry. The first and second slurries combine to form a structured web. The stratified web formed by the first slurry and the second slurry is transferred to an intermediate drying fabric 20 by the partial vacuum applied by pick-up shoe 19. The partial vacuum transfers the stratified web to the intermediate drying fabric 20 as well as reducing the adherence of the fabric side layer to the wire side layer. While on the intermediate drying fabric, the stratified web is predried to a consistency of about 50 to 90 percent fiber by weight by hot air dryer 22. The stratified web is imprinted on a Yankee dryer roll 24 by pressure roll 25 acting through the intermediate drying fabric to impress the stratified web on the Yankee dryer roller 24 and thereby form a multiplicity of discrete densified areas defining a pattern of spaced lines having a substantial orientation predisposed to buckle during creping. The Yankee dryer roll 24 dries the stratified web to a consistency of about 85 to 100 percent fiber by weight. The stratified web is then creped along each of the creping lines to form creping which is equal in frequency and simultaneous in phase in all the layers of the web.

In another preferred embodiment of the invention a ply-separable web having a barrier layer is created on two forming sections on apparatus similar to that shown in FIG. 2. A first furnish of fibers capable of forming substantial papermaking bonds is applied to a first forming wire 111*a* from the first outlet of a first headbox having multiple outlets to form a wire side web layer 113*a*. A barrier layer is deposited on the first furnish by a second outlet in the first headbox. A second furnish of fibers capable of forming substantial papermaking bonds is deposited on a second forming wire 111*b* by a second headbox having a single outlet to form a fabric side web layer 113*b*. The wire side forming wire 111*a* passes over forming boards 114*a* and vacuum boxes 115*a* which dewater the wire side web 113*a* to about 5 to 25 percent fiber by weight. The fabric side forming wire 111*b* passes over forming boards 114*b* and vacuum boxes 115*b* and is dewatered to about 5 to 25 percent fiber by weight. The fabric side forming wire 111*b* and the wire side forming wire 111*a* are then juxtaposed with the fabric side web layer 113*b* contacting the barrier layer overlying the wire side web layer 113*a*, the two webs combining into a stratified web 113. A differential pressure is applied across the forming wires by vacuum box 116 sufficient to create a single stratified web 113 of a first and second layer of papermaking fibers separated by a barrier layer. The stratified web is further dryed and unified while passing over vacuum boxes 115*c*. The forming wire 111*a* and moist web 113 pass around a Fourdrinier wire roll 117 and downwardly adjacent intermediate drying fabric 120. At this point, the paper web 113 is transferred, without compaction, to intermediate drying fabric 120 by a pressure differential between opposing sides of the web created by pick-up shoe 119 adjacent drying fabric 120, which again contributes substantially to the ply-separability of the resulting web by tending to draw webs 113*a* and 113*b* apart. Web 113 then proceeds through the dry end of the papermaking process in the manner described hereinabove.

Similarly, to produce a three layered embodiment of the inventiion a headbox such as that shown in FIG. 5 may be utilized. In this headbox, supply pipes 55, 56, and 57 supply separate slurries to portions 59, 60, and 61 of the headbox 62. In this embodiment, manifold 58 supplies a single slurry to inlet pipes 55 and 57, which will result in identical outer layers in the web when it is laid. It will be understood, however, that three different slurries could be supplied or that more than three layers could be laid within the scope of this invention. The three slurries are kept separate by fixed separators 64 and 65, and by flexible separators 68 and 69 (which again may be pivotally attached to achieve flexibility), and the three slurries are guided by converging fixed plates 66 and 67 to outlet 70. The composite slurry is then deposited on the Fourdrinier wire forming section as described above. Again, in a single wire embodiment of the invention, a fixed roof 97, attached by pivoted knuckle joint 98 to converging fixed plate 66, is employed.

A stratified web of three layers is made on one forming section from a multi-outlet headbox. Referring to FIG. 1, headbox 10 has at least three outlets depositing papermaking furnish on Fourdrinier wire 11. The furnishes for a wire side web layer 13*a* and fabric side web layer 13*b* are of fibers capable of forming substantial interlayer bonds and a barrier layer is interposed between the wire side web layer 13*a* and the fabric side web layers from becoming bound to each other. The stratified web 13 is dewatered by forming boards 14 and vacuum boxes 15. The stratified web 13 is transferred to intermediate drying fabric 20 by the application of a partial vacuum through pick-up shoe 19. The application of the partial vacuum reduces the adherence of the wire side web layer to the fabric side web layer. The stratified web 13 is predried on the intermediate drying fabric 20 by hot air dryer 22 to a consistency of from about 65 to about 90 percent fibers by weight. The stratified web 13 is imprinted on a Yankee dryer roll 24 by pressure roll 25 acting through the intermediate drying fabric 20, which forms a multiplicity of discrete densified areas defining a pattern of spaced lines having a substantial orientation predisposed to buckle during creping. The stratified web 13 is dried to a consistency of from about 85 to about 100 percent fibers by weight on the Yankee dryer roll 24. The stratified web 13 is then creped along the plural creping lines to form a creping pattern which is substantially equal in frequency and simultaneous in phase in all layers of the web.

A conventional headbox which does not have fixed or flexible separators may be used when depositing a single layer of furnish according to some of the examples set forth hereinafter.

Commercial embodiments of each of these headboxes are available from a number of sources and are well known in the art. Especially preferred headboxes used to practice the present invention are described at length in U.S. Pat. No. 3,923,593, issued to Verseput on Dec. 2, 1975, and U.S. Pat. No. 3,939,037, issued to Hill on Feb. 17, 1976, which are incorporated herein by reference.

The forming sections used to practice the embodiments of this invention may be of the single wires variety employing a fixed roof headbox, as shown in the figures and descriptions herein, or an analogous twin wire forming section may be used instead within the scope of this invention.

In a particularly preferred embodiment of the present invention, the intermediate drying fabric is characterized by a diagonal free span, i.e., the planar distance as measured from one corner of a projected fabric mesh opening to its diagonally opposite corner, between about 0.01 inches and about 0.1 inches, most preferably between about 0.015 inches and about 0.04 inches, and a fabric mesh count of between about 100 and 3,600 openings per square inch, i.e., said fabric having between about 10 and about 60 filaments per inch in both the machine and cross-machine directions.

In a long fiber/short fiber stratified web of the type referred to herein as the two-layered embodiment of the invention, it is preferable that the diagonal free span of the intermediate drying fabric be less than the average fiber length of the short fiber stratum of the web. If the diagonal free span is greater than the average fiber length in the short-fibered stratum of the web, the fibers are two easily pulled through the fabric mesh openings when subjected to fluid pressure, thereby detracting from the bulk and caliper of the finished sheets. On the other hand, the diagonal free span of the fabric is preferably greater than about $\frac{1}{3}$, and most preferably greater than about $\frac{1}{2}$ of the average fiber length in the short fiber stratum of the web in order to minimize bridging of the short fibers across the fabric filaments. In addition, the diagonal free span of the fabric is preferably less than about $\frac{1}{3}$ of the average fiber length of the long fiber stratum of the web in order to encourage bridging of the long fibers across at least one pair of fabric filaments. Accordingly, the short fibers tend to reorient themselves and penetrate the fabric mesh openings during transfer of the moist stratified web to the intermediate drying fabric, while the long fibers tend to bridge the openings in the mesh, and thus the long fiber stratum remains substantially planar. The patterned discrete areas of the web which correspond to the fabric mesh openings and which extend outwardly from the fabric side of a web of the type generally shown in FIG. 6 typically assume the form of totally enclosed pillows, conically grouped arrays of fibers, or a combination thereof.

The inventors believe that the quality of ply-separability, particularly in the two-layer one headbox embodiment of the invention, results from maintenance of the distinct fiber compositions in the several layers of the stratified web, particularly as the layers come together to form a unitary web. This maintenance of distinctness among layers deposited from a single headbox in the forming section of the papermaking machine allos production of layers in the completed product which have fiber compositions similar to the fiber compositions in the slurries supplied to the headbox. It is important in realizing the object of ply-separability, therefore, to utilize a headbox design which minimizes flow turbulence and which equalizes as nearly as possible the relative velocities of flow for the respective furnishes as they leave the divided headbox utilized in some embodiments of this invention.

In the two-layer embodiment of the invention in which two forming sections are employed, the distinctness of the layers which are formed separately is more easily maintained because no two layers are joined until they have much greater consistency than the headbox throat consistency, and equal velocity of layers is maintained by running the respective forming wires at substantially equal velocities.

An especially preferred predrying apparatus for use in the papermaking processes disclosed herein is described in U.S. Pat. No. 3,303,576, issued to Sisson on February 14, 1967 and commonly owned with this application. The Sisson patent is incorporated herein by reference. (Dry bulb input temperatures for each predryer stage are measured in the air input plenum of the predryer, and dry bulb output temperaturess for each stage are measured immediately adjacent the side of the web which is downstream with respect to the direction of air travel through the predryer.)

The web of the present invention may be creped using any of a number of known techniques. While several types of creping are discussed hereinafter, the applicants do not limit themselves to thes techniques, as they envision that many techniques will be useful to crepe ply-separable webs of the present invention.

First, the web may be creped may be creped by adhering it to a creping roll and then shearing it from the roll with a doctor blade, as is well known in the art. As indicated hereinbefore, this particular type of creping is not essential to the present invention, and ply-separability is not imparted to the web by this step, since the web is already ply-separable on the intermediate drying fabric.

Second, creping may be imparted to the web by a process known hereinafter as MICREX creping. (MICREX is a trademark of Bird Machine Co., Micrex Division, Walpole, Massachuesetts.) This technique is illustrated and described in U.S. Pat. No. 3,260,778, issued to Walton on July 12, 1966; Pat. No. 3,416,192, issued to Packard on Dec. 17, 1968; and Pat. No. 3,426,405, issued to Walton on Feb. 11, 1969. The foregoing three patents are incorporated herein by reference.

Third, a web made according to this invention may be creped by confining it between a rubber belt and a pulley fact at varying tensions to produce micro-creping. This creping technique, known as CLUPAK treatment in the art (CLUPAK is a trademark of Clupak, Inc. of New York.), is disclosed in U.S. Pat. No.

2,624,245, issued to Cluett on Jan. 6, 1953, and that patent is hereby incorporated herein by reference.

EXAMPLE 1: Two-layered Ply-Separable Web Formed in a Single Forming Section

In this embodiment of the invention, a two-layered web is formed from a single divided headbox, and has a first layer (disposed nearest the forming wire) comprised of a relatively concentrated slurry of short papermaking fibers, overlaid by a second layer of furnish having a somewhat lower consistency of longer papermaking fibers. Thus, a papermaking machine such as that shown in FIG. 1 and a headbox of the type shown in FIG. 4 is used. What follows is a specific example of the production of a ply-separable web according to this embodiment.

A first furnish, to be laid adjacent the forming wire, was comprised of 100 percent kraft eucalyptus pulp. The fiber was combined with 4.7 pounds of a 2 percent solution (by weight) of PAREZ 631NC wet strength resin per ton of fiber, and was unrefined. (PAREZ 631NC is a modified polyacrylamide wet strength resin available from the American Cyanamid Company.) The basis weight of the first furnish was 10.8 pounds per 3,000 sq. ft., and it was supplied to the headbox at a flow rate of 111 gallons per minute and at a consistency at the headbox of 0.26 percent fiber by weight.

An unrefined second papermaking furnish, to be superimposed on said first furnish, was comprised of 70 percent northern softwood kraft and 30 percent northern hardwood sulfite pulps, along with 7.5 pounds of a 1 percent solution (by weight) ACCOSTRENGTH 98 dry strength additive per ton of fiber, (ACCOSTRENGTH 98 is the trade name of a dry strength additive comprised of a modified polyacrylamide material, available from the American Cyanamid Company.), and 14 pounds per ton of fiber of a 4 percent solution (by weight) of ACCOSTRENGTH 514 promoter (ACCOSTRENGTH 514 is the trade name for a linear quaternary ammonium compound available from the American Cyanamid Company.) This furnish was supplied to the headbox at a flow rate of 272 gallons per minute and at a consistency at the headbox of 0.107 percent fiber by weight. When laid on the Fourdrinier wire, this furnish had a basis weight of 10.8 pounds per 3,000 square feet.

The first and second furnishes were deposited in superimposed relation on a 78 mesh Fourdrinier wire (a style 78(s) wire, available from Appleton Wire Corporation). The headbox throat opening was set at 0.75 inches. The rate of travel of the Fourdrinier wire was 503 feet per minute. The ratio of the flow rate of the wire side furnish to the flow rate of the fabric side furnish was approximately 2.45 to 1.

The stratified web was then dried to a consistency of about 23 percent fiber by weight, and the breast roll vacuum setting was 1.5 inches Hg. The web was then transferred to a second Fourdrinier wire by a vacuum box vacuum of 11.5 inches Hg., so that the first furnish above formed the fabric side layer and the second furnish formed the wire side layer. The pickup shoe had a vacuum of 16.5 inches Hg., and in the course of transferring the web to the intermediate drying fabric the consistency of the web was increased to about 24 percent fiber by weight.

The intermediate drying fabric for this run was an 18 by 16 mesh semi-twill fabric, available from Hermann Wangner GmbH of the Federal Republic of Germany. The fabric was run at a speed of 501 feet per minute, resulting in a draw with respect to the Fourdrinier wire of minus 2 feet per minute. The input dry bulb air temperature of the first stage of the pre-dryer was about 360° F., and the output dry bulb air temperature in the first stage was about 135° F. The input dry bulb air temperature of the second stage was about 350° F., and the output dry bulb air temperature of the second stage was about 205°. As a result of pre-drying the web consistency was 80 percent fiber by weight.

In this run, the web was adhered to a Yankee dryer and creped therefrom using a doctor blade. A 0.5 percent (by weight) solution of polyvinyl alcohol adhesive sold under the trademark GELVATOL by The Monsanto Company was sprayed on the Yankee dryer in an amount of about 2 lbs/ton of fiber to facilitate Yankee drying and creping. The web was pressed against the Yankee dryer and imprinted by the pressure roll at a nip loading of 365 pounds per linear inch. The steam pressure supplied to the Yankee dryer was 122 psig. The surface speed of the Yankee dryer was 501 feet per minute. As a result of Yankee drying, the web was dried to a consistency of about 99.6 percent fiber by weight.

The web was creped from the Yankee dryer using a doctor blade set at an impact angle about 90 degrees. As a result of creping, the web was longitudinally compressed and wound at a web speed of about 373 feet per minute. The resulting web had net creping of about 25.5 percent, a final basis weight of about 29 pounds per 3,000 square feet, and a crepe frequency of about 21–22 cycles per inch.

Example 2: Two-layered Ply-separable Web, Each Layer Formed in a Separate Forming Section In this embodiment of the invention, a first web is formed by wet-laying a furnish comprised of long papermaking fibers in a first forming section, and a second web is formed by wet-laying a furnish comprised of shorter papermaking fibers in a second forming section. The webs are partially dewatered, then brought together to form a single stratified web while each is still in the forming section. The short fiber layer has a much lower consistency than that of the long fiber layer at the point where the two webs are allowed to contact each other. After the webs are combined, the further treatment of the web is essentially identical to the treatment described above for the two-layered ply-separable web formed in a single forming section. What follows is a specific example of the practice of this embodiment of the invention.

The wire side layer was comprised of 100 percent northern softwood kraft pulp to which was added 7.5 pounds of a 2 percent solution of PAREZ 631NC wet strength resin per ton of fiber. The wire side of the furnish was refined at no load in a disc refiner to increase its dry tensile strength. The headbox throat was set at 0.50 inches, the breast roll had a vacuum of 1.0 inches Hg., and a single vacuum box set at a vacuum of 3.5 inches Hg. was used to begin the dewatering of the wire side layer. At the point where the wire side layer and the fabric side layer were combined, the wire side layer had a consistency of about 17 percent fiber by weight, and the basis weight of the wire side layer was about 11.1 pounds per 3,000 sq. ft.

The fabric side of the furnish was comprised of 100 percent northern hardwood sulfite pulp, laid at a basis weight of 11.1 pounds per 3,000 square feet and having a consistency of 10.4 percent fiber by weight at the time the fabric side and wire side layers were combined into a single stratified web. The level of PAREZ 631NC wet strength resin solution applied to this layer was again 7.5 pounds per ton of fiber. The headbox throat setting was 0.775 inches. The breast roll vacuum for this layer was 0.75 inches Hg. and a single vacuum box maintaining a vacuum of 3 inches Hg. was used to dewater the web. The speeds of each Fourdrinier wire were approximately equal to the speed cited in the two-layer single wire embodiments described above.

At the point where the wire side and fabric side webs were combined, combination was facilitated by a vacuum box applying a vacuum of about 5 inches Hg., creating a pressure differential between the respective sides of the web to unify them into a unitary web. The consistency of the combined stratified web at the point of transfer to the intermediate drying fabric was 18.1 percent fiber by weight, increased to about 26.7 percent fiber by weight as the result of dewatering resulting from the pressure differential applied at the pickup shoe. The first stage predryer input dry bulb air temperature was about 460° F. and output dry bulb air temperature was 150° F.; the second stage predryer input dry bulb air temperature was about 470° F. and output dry bulb air temperature was about 270° F. Consistency of the web after predrying was 95.1 percent fiber by weight. In this run, the web was again finally dried and creped by adhering it to a Yankee dryer and shearing it therefrom with a doctor blade. The operating parameters for the Yankee dryer and creping were comparable to those measured in the first example above.

Example 3: Three-layered Ply-separable Web Formed in a Single Forming Section In this embodiment of the invention, three distinct layers of furnish are laid by a divided headbox onto a single Fourdrinier wire forming section and further processed to form a ply-separable paper web comprised of two distinct, well-bonded layers of tissue, separated by an intermediate barrier layer. (It will be noted, however, that the finished product is separable into two plies, rather than three plies, for when the plies are separated the barrier adheres to one of the well-bonded layers, or fragments of the barrier each adhere to one or the other of the well-bonded layers.)

To practice this embodiment, a web is formed from a three-channel headbox which deposits identical layers comprised of 50 percent northern softwood kraft pulp and 50 percent northern hardwood sulfite pulp, each layer having a basis weight of about 7.5 pounds per 3,000 square feet, and a central layer therebetween comprised of 100 percent mercerized sulfite pulp having a basis weight of about 7.5 pounds per 3,000 square feet. The web is dried on the Fourdrinier wire to a consistency of about 20 percent fiber by weight, transferred to an intermediate drying fabric, predried to a consistency of about 95 percent fiber by weight, and found to be ply-separable upon removal from the intermediate drying fabric. In this example, the pickup shoe vacuum is about 15 inches Hg. The web is then rolled up without being creped. The resulting web is ply-separable at this point. Ultimately the web is creped to produce a finished product.

Example 4: Three-layered Ply-separable Web, Formed in Two Forming Sections

In this embodiment of the invention, a stratified first web is formed by depositing on a Fourdrinier wire a first furnish adapted to form strong internal papermaking bonds and a superimposed furnish which forms the barrier layer of a three-layered embodiment of the invention. On a separate Fourdrinier wire, a second web adapted to form strong internal papermaking bonds is laid and partially dewatered before it is superimposed adjacent the barrier layer of the stratified first web. The two webs are then combined into a single stratified web having three layers two ply-separable layers having strong papermaking bonds, and a barrier layer separating them. (When superimposed, the second web defines the fabric side of the assembled web, while the first furnish of the first web defines the wire side of the assembled web.)

As an example of this embodiment of the invention, furnishes capable of forming well-bonded layers were formed from 50 percent northern softwood kraft and 50 percent northern hardwood sulfite pulps, while the furnish which ultimately would comprise the barrier layer of the assembled web was comprised of 100 percent mercerized sulfite pulp. Each well-bonded layer had a basis weight of 5.5 pounds per 3,000 square feet, and the barrier layer had a basis weight of 10.9 pounds per 3,000 square feet. The total throat setting for each headbox was 0.60 inches.

A dry strength additive was included in the well-bonded layers, consisting of 18 pounds of a 1 percent solution of ACCOSTRENGTH 98 per ton of fiber and 65 pounds of a 4 percent solution ACCOSTRENGTH 514 per ton of fiber.

For the web deposited from the divided headbox, the first furnish was supplied at a rate of 171 gallons per minute and the superimposed furnish was supplied at a rate of 175 gallons per minute. The consistency at the headbox throat for the first furnish, which would form the fabric side layer in the assembled web, was 0.17 percent fiber by weight and the headbox throat consistency for the superimposed furnish was 0.36 percent fiber by weight. In the layer deposited from the single channel headbox, the furnish was supplied at 517 gallons per minute, and the consistency at the headbox throat was 0.06 percent fiber by weight. The vacuum boxes, which unify the separate webs into a single stratified web when the webs are juxtaposed by creating a pressure differential between the respective sides of the combined webs, were maintained at vacuum levels of 10 inches Hg. and 7 inches Hg., respectively. No vacuum was applied at the breast rolls in this embodiment. The vacuum box for the wire-side layer was maintained at a vacuum of 5 inches Hg.

When the unified web was transferred to the intermediate drying fabric, which was the same type of fabric described hereinbefore, the pickup shoe was maintained at a vacuum of 15 inches Hg., and the vacuum boxes were maintained at a vacuum of 13 inches Hg. Before the web was transferred to the intermediate drying fabric, its consistency was 20.1 percent fiber by weight, and after passing over the vacuum boxes the consistency was 27.5 percent fiber by weight. The web was passed through the two-stage predrier at a first stage dry bulb air input temperature of about 380° F., a first stage dry bulb air output temperature of about 160° F., a second stage dry bulb air input temperature of about 380° F. and a second stage dry bulb air output temperature of about 230° F. After predrying, the fiber consistency was 87.9 percent fiber by weight, and the web was ply-separable at this point. GELVATOL adhesive was applied at a level of 2 pounds per ton of fiber to the Yankee dryer, and the web was imprinted thereon by the pressure roll operating at a nip loading of 325 pounds per linear inch. The Yankee dryer steam pressure was 122 psig. The consistency of the web at the time of creping was 99.2 percent fiber by weight.

As a result of this procedure, a final web was formed having a basis weight of 28.7 pounds per 3,000 square feet, having a caliper of 0.0268 inches. In this embodiment the speed of the surface of the Yankee dryer was 601 feet per minute and the speed at which the web was wound after creping was 458 feet per minute, resulting in a net creping of 23.8 percent.

The Barrier Layer

It will be understood that any of a number of barrier layer configurations can be used to achieve the ply-separability of the three layer embodiment this invention. By way of example, fibers which do not form papermaking bonds, or (like mercerized pulp) form papermaking bonds at reduced strength, or do not adhere as a layer to the separable layers, may be interposed between well-bonded layers to produce a ply-separable paper. Many synthetic fibers such as polyester or the like fit into this category. Chemical debonding agents may be added to the barrier layer in order to selectively prevent the formation of papermaking bonds. Examples of suitable debonding agents are Quaker 2000, manufactured by Quaker Chemical Co., Conshohocken, Pennsylvania, as well as the debonding agents referred to in Column 8 of U.S. Pat. No. 3,812,000 issued May 21, 1974 to Salvucci, Jr. et al., and in references cited therein, all of which is incorporated herein by reference. A fluid such as (but not limited to) water may be introduced through the central channel of a three-channel divided headbox, and thus be interposed between two furnishes to initially separate them and reduce intermingling of fibers until the water is removed during the papermaking process. Other fluids which can be used to separate the well-bonded layers until they no longer will interlink with strong papermaking bonds are air or another gas which may be introduced between the outer layers of furnish to keep them physically separated to reduce intermingling of fibers. A solid or powdered material capable of sublimation may also be interposed between the separable plies to temporarily isolate them during the papermaking process. In all of these variations, it will be noted that it is not necessary to incorporate materials in the web which will substantially inhibit the absorptive properties of the finished tissue produced.

Product Description

FIGS. 6 through 10 illustrate schematically the attributes of a paper web made accordingly to any of the processes described above.

Referring first to FIG. 6, intermediate drying fabric 84 is made up of machine direction filaments 81 and cross-machine direction filaments 91. Knuckles such as 83 and 90 are formed in areas of fabric 84 where a machine direction filament and a cross-machine direction filament overlap. Referring to FIG. 7, which shows the view of FIG. 6 with machine direction filament 91 cut away, web 80 is comprised of fabric side layer 85 and wire side layer 86, which are the outside layers of the three-layer embodiments of the invention, or both layers of the two-layer embodiments of the invention. Densified areas such as 82 and void spaces such as 87 are evident in the web at this stage of the papermaking process, although they are accentuated by further treatment.

FIGS. 8 and 9 show the treatment of some embodiments of the invention wherein the intermediate drying fabric and the attached web are passed through a nip between pressure roll 88 and another roll 89, which may be a Yankee dryer drum. The result of this treatment is the compaction of densified areas 82 by knuckles 83. However, this treatment does not substantially compact void spaces 87. As a result of this treatment, densified areas 82 become buckling sites which influence crepe frequency and cause the creping of the respective layers to be in phase.

FIG. 10 illustrates the web which results from the papermaking processes described by the applicants herein. Fabric and wire side layers 85 and 86 are distinct, and are separated at intervals by void spaces 87. Creping causes the void spaces 87 to open up, thus increasing the absorbency and bulk of the final product. The creping of the web is evident on either side thereof, although only one creping step is employed, and the creping is equal in frequency and simultaneous in phase in each layer of the finished web.

Product Test Procedures

Tests conducted on the products of the examples described above were carried out as follows:

Dry Caliper

This was obtained on a Model 549M motorized micrometer such as is available from Testing Machines, Inc. of Amityville, Long Island, New York. Product samples were subjected to a loading of 80 gm. per sq. in. under a 2 in. diameter anvil. The micrometer was zeroed to assure that no foreign matter was present beneath the anvil prior to inserting the samples for measurement and calibrated to assure proper readings. Measurements were read directly from the dial on the micrometer and are expressed in mils.

Calculated Density

The density of each sample sheet was calculated according to the following equation:

$$\text{(Calculated Density, g./cc.)} = \frac{(.064)\ \text{(Basis weight, lb./3000 sq. ft.)}}{\text{(Dry Caliper, mils)}}$$

where 0.064 is a conversion factor.

Dry Tensile Strength

This was obtained on a Intelect 500 tensile tester such as is available from the Thwing-Albert Instrument Company of Philadelphia, Pennsylvania. Product samples measuring 1 inch wide were cut in both the machine and cross-machine directions. For each run, a sample strip was placed in the jaws of the tester, set at a 2 in. gauge length. The crosshead speed during the test was 4 in. per minute. Readings were taken directly from a digital readout on the tester at the point of rupture to obtain the tensile strength of an individual sample. Results are expressed in grams per inch of sample width.

Stretch

Stretch is the percent machine direction or cross-machine direction elongation of the sheet, as measured at rupture, and is read directly from a second digital readout on the Intelect 500 tensile tester. Stretch readings were taken concurrently with tensile strength readings.

Tearing Resistance

This was obtained on a 200-gram capacity Elmendorf Model 60-5-2 tearing tester such as is available from the Thwing-Albert Instrument Company of Philadelphia, Pennsylvania. The test is designed to measure the tearing resistance in the machine direction of sheets in which a tear has been started. Product samples were cut to a size of 2½ in. by 3 in., with the 2½ in. dimension aligned parallel to the machine direction of the samples. Eight product samples were stacked one upon the other and clamped in the jaws of the tester so as to align the direction of tear parallel to the 2½ in. dimension. A ½ in. long cut was then made at the lowermost edge of the stack of samples in a direction parallel to the direction of tear. A model 65-1 digital read-out unit, also available from the Thwing-Albert Instrument Company, was zeroed and calibrated using an Elmendorf No. 60 calibration weight prior to initiating the test. Readings were taken directly from the digital read-out unit and inserted into the following equation:

$$\text{Tear Resistance} = \frac{(.01)\,(TTC)\,(DR)}{\text{number of plies tested}}$$

Where TTC is tearing tester capacity in grams, and DR is the reading from the digital readout unit. Results are expressed in terms of grams per ply of product.

Burst Strength

This test is used to determine how much force can be exerted by a plunger driven perpendicularly against a clamped paper sample before the sample will burst and allow the plunger to pass through it.

The test is performed using a burst tester fabricated by the Thwing-Albert Instrument Co. The instrument is calibrated, then a sample of a product to be tested is clamped between the upper and lower rings of the burst tester and the plunger drive is actuated. The machine will read out the burst strength directly in grams at the time of sample rupture.

Center Point Wicking Test

This test is performed to measure wicking, which is the ability of a paper sample to absorb liquid and rapidly distribute it over a wide area. Such a property is desirable in absorbent products of all kinds because a product with good wicking more effectively utilizes its entire absorptive capacity by avoiding localized wet spots.

The machine used to perform this test (which is not commercially available) comprises an upstanding polytetrafluoroethylene tube having an inside diameter of 0.3125 inches, connected with reservoir means to maintain a constant water level at the tip of the tube very slightly above its lip while a test is in progress, and to supply water to the lip as it is demanded during the test.

A 5 inch diameter sample of known dry weight is suspended in a horizontal plane with the center of its lower face adjacent the upstanding tube, and a type 6005BO4COX weighing cell (available from Automatic Timing and Controls, Inc. of King of Prussia, Pennsylvania) attached to the sample continuously records the weight of the sample as it becomes laden with water.

To initiate the test, the water in the upstanding tube is raised to its operative level, forming a meniscus at or above the lip of the tube. Contact between the sample and meniscus occurs and is maintained as water is absorbed from the tube. The test continues for 60 seconds, and the weight of water absorbed by the sample is recorded. Results are expressed as grams of water absorbed per gram of dry sample weight. A high result indicates rapid wicking, and vice versa.

Peel Test

An Instron Model TMS tensile testing machine available from Instron Corporation, Canton, Massachusetts is used to conduct this test. Samples are cut 1 inch wide and 6 inches long for the test. Cellophane tape is attached to opposing sides of the sample adjacent a common edge and a "T-shaped" peel is started across the entire width of the sample by hand. (When the peel test is carried out, neither of the plies is backed by tape at the site of ply separation.) The respective tapes are clamped in the top and bottom jaws of the tensile testing machine, and the load which must be applied to further peel the layers apart in the machine direction is measured in grams. If the sample tested is not ply-separable, peeling will not occur. Rather, one or both of the tapes will pull away from the sample, carrying only a small amount of fibrous material pulled from the surfaces of the sheet.

Ply Separation Test

This test is performed using an Instron Model TMS tensile testing machine or its equivalent. In this test, the entire surface of each side of a circular sample with a diameter of 1.25 inches is adhered to the opposing generally planar pulling surfaces of the machine, which lie in planes perpendicular to the direction of pull to be exerted by the tester. (Adherance is effected by applying 1.125 inch discs of two-sided tape between the machine jaws and the respective sides of the sample.) A pulling force is then applied to the sample until the plies separate--unlike the peel test, in this test the entire sample delaminates simultaneously, or nearly so. The load needed to effect separation of the plies is then recorded, measured in grams.

Control Samples

To develop a standard for comparison of ply-separable paper webs of the present invention with a stratified non-ply-separable paper web (hereinafter: "reversed strata web") and with a homogeneous paper web, examples of the latter webs were produced on the same machine used in Example 4 above. Process conditions for these runs are summarized in Table I, aligned adjacent the same data of Example 4 for comparison. In Table I, layer W is the second web of Example 4 or its equivalent, layer F is the layer formed from the first furnish of the first web of Example 4 or its equivalent, and layer C is the layer which becomes the barrier layer of the web. The homogeneous paper web was formed entirely from the headbox which deposited layer W in the other runs. Also in Table I, "N.S.K." is northern softwood kraft pulp "N.H.S." is northern hardwood sulfite pulp, and "M.S." is mercerized sulfite pulp.

TABLE I

| Parameter | Example 4 | Homogeneous Web | Reversed Strata Web |
|---|---|---|---|
| Composition: | | | |
| Layer F | 50% N.S.K. | — | 100% M.S. |
| | 50% N.H.S. | — | — |
| Layer W | 50% N.S.K. | 25% N.S.K. | 100% M.S. |
| | 50% N.H.S. | 25% N.H.S. | — |

TABLE I-continued

| Parameter | Example 4 | Homogeneous Web | Reversed Strata Web |
|---|---|---|---|
| | — | 50% M.S. | — |
| Layer C | 100% M.S. | — | 50% N.H.S. |
| | — | — | 50% N.S.K. |
| Basis Weight (Fraction of sample): | | | |
| Layer F | .25 | — | .25 |
| Layer W | .25 | 1.0 | .25 |
| Layer C | .50 | — | .50 |
| Throat Settings | * | * | * |
| Headbox flows; gallons/min.: | | | |
| Layer F | 171 | — | 191 |
| Layer W | 517 | 513 | 510 |
| Layer C | 175 | — | 184 |
| Headbox Consistencies, % fiber: | | | |
| Layer F | 0.17 | — | 0.15 |
| Layer W | 0.06 | 0.24 | 0.06 |
| Layer C | 0.36 | — | 0.34 |
| Vacuum Box Vacuum Level | * | * | * |
| Breast Roll Vacuum Level | * | * | * |
| Pickup Shoe Vacuum Level | * | * | * |
| Webs Consistencies, % Fiber: | | | |
| Before transfer to fabric: | 20.1 | 22.2 | 20.0 |
| Before predryer | 27.5 | 26.2 | 26.9 |
| After predryer | 87.9 | 72.2 | 82.4 |
| At creping | 99.2 | 98.7 | 99.2 |
| Predryer Temperatures: | | | |
| 1st stage input | 380 | 380 | 415 |
| 1st stage output | 165 | 150 | 170 |
| 2nd stage input | 380 | 380 | 410 |
| 2nd stage output | 230 | 220 | 240 |

*Indicates identical values for each run, as per example 4.

Test Results

Table II indicates the results of the above tests for the examples and control samples previously described:

TABLE II

| Test | Example 1 | Example 2 | Example 4 | Control Homogeneous | Control Reversed Strata |
|---|---|---|---|---|---|
| Dry Caliper (mils) | 27.5 | 27.3 | 27.9 | 25.3 | 27.8 |
| Calculated Density (g/cc.) | .0711 | .0688 | .0657 | .0674 | .0609 |
| Dry Tensile Strength (g/inch of width) | | | | | |
| Machine Direction | 411 | 450 | 183 | 357 | 475 |
| Cross Direction | 308 | 384 | 217 | 334 | 421 |
| Total | 719 | 834 | 400 | 691 | 896 |
| Stretch (percent) | | | | | |
| Machine Direction | 23.0 | 28.4 | 25.1 | 36.3 | 29.8 |
| Cross Direction | 5.1 | 4.6 | 6.2 | 7.4 | 4.7 |
| Tearing Resistance (g./ply) | 17 | 20 | 32 | 29 | 35 |
| Peel Test (g.) | 6.87 | 18.7 | 2.24 | # | # |
| Ply Separation Test (g.) | 493 | 957 | 173 | * | * |
| Basis Weight (lb./3000 sq. ft.) | 30.6 | 29.4 | 28.7 | 26.7 | 26.5 |
| Burst (g) | 175 | 165 | 122 | 182 | 147 |
| Center Point Wicking Test (g. $H_2O$ per g. Sample) | — | — | 4.244 | 3.159 | 2.504 |

#Plies would not separate;
*layer failure preceded ply separation.

A comparison in Table II of the data for Example 4 versus the control data illustrates the presence of ply separation as a function of the type of fiber used in the central layer of the three-layer embodiment of the invention. This data illustrates that while the tensile strength, stretch, and burst parameters for the ply-separable web of Example 4 are not optimal (although they are acceptable), nevertheless ply-separation is present in the Example 4 data and absent in the control data.

The center point wicking test also illustrates a significant improvement in rate of absorbency for the Example 4 web as compared to the control webs which have similar basis weights.

Data is not reported for Example 3, as that is a hypothetical example. However, the inventors predict that the product of Example 3 is ply-separable.

We claim:

1. A method to produce a ply-separable web, comprising the steps of:
   (a) forming a wire side web layer of long papermaking fibers on a first forming wire, said wire side web layer having a consistency of about 10 to 25 percent fiber by weight at the point of juxtaposition with a fabric side web;
   (b) forming said fabric side web layer of short papermaking fibers on a second forming wire, said fabric side web layer having a consistency of from about 5 to 15 percent fiber by weight, whereby the consistency of said wire side web layer is about 5 to 10 percent by weight greater than the consistency of the fabric side web layer at the point of juxtaposition with the wire side web:
   (c) juxtaposing said first and second forming wires with said fabric side web and wire side web layers disposed therebetween, bringing said first and second wires into contacting relation to form a combined web;
   (d) applying a sufficient differential pressure to said combined web to unify it into a stratified web having first and second strata which are weakly bound together by papermaking bonds;
   (e) applying a partial vacuum to said stratified web adjacent said fabric side of the web, whereby to transfer said stratified web to an intermediate drying fabric and to reduce the adherence of said wire side web and fabric side web layers to each other;
   (f) drying said stratified web while it is on said intermediate drying fabric, to a consistency of about 85 to 100 percent fibers by weight; and
   (g) creping said stratified web in a single operation to produce a web with creping which is equal in frequency and simultaneous in phase in each layer of said stratified web.

2. The method of claim 1, wherein said fabric side and wire side webs are unified by passing said justaposed first and second forming wires over a vacuum source situated adjacent one of said forming wires on the side thereof opposite said combined web.

3. The method of claim 1, wherein said intermediate drying fabric has a mesh size of about 100 to 3,600 openings per square inch.

4. The method of claim 1, wherein said stratified web is adhered to a creping roll and then creped therefrom using a doctor blade.

5. The method of claim 1, wherein said stratified web is creped by conveying it between a driving roll and a stationary surface into a retarding zone so that the speed of the web as it enters the retarding zone exceeds the speed of the web as it leaves the retarding zone.

6. The method of claim 1, wherein said stratified web is creped by applying a compressive force parallel to its respective surfaces in a longitudinal direction while simultaneously applying a force perpendicular to said faces.

7. A method to produce a ply-separable paper web, comprising the steps of:

(a) forming a wire side web layer of long papermaking fibers on a first forming section, and dewatering said wire side web layer to a consistency of from about 10 to 25 percent fiber by weight at the point of juxtaposition with a fabric side web;

(b) forming said fabric side web layer of short papermaking fibers on a second forming wire and dewatering said fabric side web layer to a consistency of from about 5 to 15 percent fiber by weight, whereby the consistency of said wire side web layer is from about 5 to 10 percent by weight greater than the consistency of the fabric side web layer at the point of juxtaposition with the wire side web;

(c) juxtaposing said first and second forming wires with said wire side web and fabric side web layer disposed therebetween to bring said wire side web and said fabric side web layers into contacting relation to form a combined web;

(d) applying a sufficient differential pressure to the respective sides of said combined web to unify it into a stratified web having at least first and second adjacent strata which are weakly bound together by papermaking bonds;

(e) applying a partial vacuum to said stratified web adjacent said fabric side layer whereby to transfer said stratified web to an intermediate drying fabric and to reduce the adherence of said wire side and fabric side layers to each other;

(f) predrying said stratified web to a consistency of about 50 to 95 fiber by weight;

(g) imprinting said stratified web on a drying roll means through a pressure roll means acting on said intermediate drying fabric, wherein said stratified web is disposed between said intermediate drying fabric and drying roll means, to form a multiplicity of discrete densified areas defining a pattern of spaced lines having a substantial orientation predisposed to buckle during creping;

(h) drying said stratified web to a consistency of from about 85 to 100 percent fiber by weight; and (i) creping said stratified web along each of said creping lines to form creping which is equal in frequency and simultaneous in phase in all the layers of the web.

8. The method of claim 7, wherein said fabric side and wire side webs are unified by passing said juxtaposed first and second forming wires over a vacuum source situated adjacent one of said forming wires on the side thereof opposite said combined web.

9. The method of claim 7, wherein said intermediate drying fabric has a mesh size of about 100 to 3,600 openings per square inch.

10. The method of claim 7, wherein said stratified web is adhered to a creping roll, and creped therefrom using a doctor blade.

11. The method of claim 7, wherein said stratified web is adhered to a Yankee dryer, and creped therefrom using a doctor blade.

* * * * *

UNITED STATES PATENT AND TRADEMARK OFFICE

CERTIFICATE OF CORRECTION

PATENT NO. : 4,225,382

DATED : September 30, 1980

INVENTOR(S) : DONALD R. KEARNEY, PAUL D. TROKHAN, EDWARD R. WELLS

It is certified that error appears in the above-identified patent and that said Letters Patent are hereby corrected as shown below:

Column 2, line 15, "operation" should read -- operations --.

Column 3, line 5, "ayer" should read -- layer --.

Column 4, line 15, "Fig. 10" should start a new paragraph.

Column 5, line 26, "play-separable" should read -- ply-separable --.

Column 6, line 42, "113Ib" should read -- 113b --.

Column 8, line 4, "as" should read -- is --.

Column 8, line 57, "into" should read -- onto --.

Column 11, line 24, "wires" should read -- wire --.

Column 12, line 42, "thes" should read -- these --.

Column 12, line 65, "fact" should read -- face --.

Column 22, line 30, the colon should be a semi-colon.

Column 22, line 53, "justaposed" should read -- juxtaposed --.

Signed and Sealed this

Ninth Day of March 1982

[SEAL]

Attest:

GERALD J. MOSSINGHOFF

Attesting Officer

Commissioner of Patents and Trademarks